US005272291A

United States Patent [19]

Erickson

[11] Patent Number: 5,272,291

[45] Date of Patent: Dec. 21, 1993

[54] DUAL SWITCH ACTUATOR MECHANISM WITH GENEVA DRIVE PLATE AND FOLLOWER PLATES DETENT ASSEMBLY

[75] Inventor: James A. Erickson, Crystal Lake, Ill.

[73] Assignee: Boltswitch, Inc., Crystal Lake, Ill.

[21] Appl. No.: 816,032

[22] Filed: Dec. 30, 1991

[51] Int. Cl.[5] ..... H01H 3/44; H01H 9/00

[52] U.S. Cl. ..... 200/18; 74/820; 200/50 C

[58] Field of Search ..... 200/18, 50 C, DIG. 42, 200/11 TC; 74/820

[56] References Cited

U.S. PATENT DOCUMENTS

| | | | |
|---|---|---|---|
| 2,253,183 | 8/1941 | Le Count | 200/11 TC X |
| 3,213,247 | 10/1965 | Stene | 337/146 |
| 3,441,699 | 4/1969 | Erickson | 200/144 R |
| 4,103,133 | 7/1978 | Erickson et al. | 200/18 |
| 4,110,584 | 8/1978 | Erickson et al. | 200/304 |
| 4,137,433 | 1/1979 | Erickson et al. | 200/50 A |

*Primary Examiner*—J. R. Scott

*Attorney, Agent, or Firm*—Kinzer, Plyer, Dorn, McEachran & Jambor

[57] ABSTRACT

A dual switch actuator for coordinated actuation of two high-current switches, each having a switch operator with a shaft. The switch operator shafts are aligned paraxially with a main shaft of the actuator. A Geneva drive plate having an arcuate bearing surface and two drive pins is affixed to the main shaft. A modified Geneva follower plate is affixed to each of the switch operator shafts. Each follower plate has a drive slot for receiving a drive pin and a bearing surface complementary to the drive plate bearing surface. In a neutral position of the main shaft, each drive pin is positioned at a follower plate drive slot entrance and both follower plates bearing surfaces engage the main drive plate bearing surface. Rotation of the main shaft in either direction from neutral causes one guide pin to move inwardly of the follower plate drive slot, rotating the follower plate and its associated switch operator shaft to actuate one switch without actuation of the other. A detent prevents rotation of the main shaft in either direction from neutral to engage one of the follower plates and rotate it and its associated switch operator shaft to move its switch contacts to a closed position when the other of the follower plates is in a position of rotation slightly short of its fully open position, a position which could occur if the switch contacts associated with the switch of the other follower plate were welded in a partially closed, actuated condition.

4 Claims, 3 Drawing Sheets

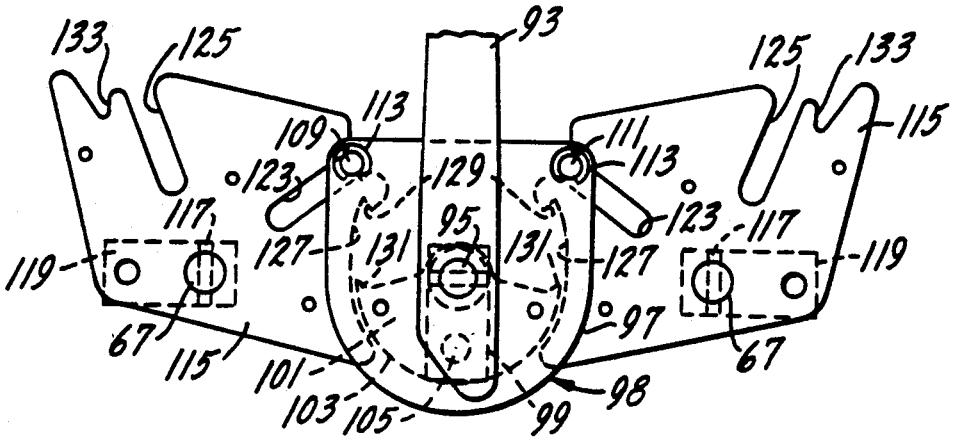
Fig. 4.
Fig. 5.
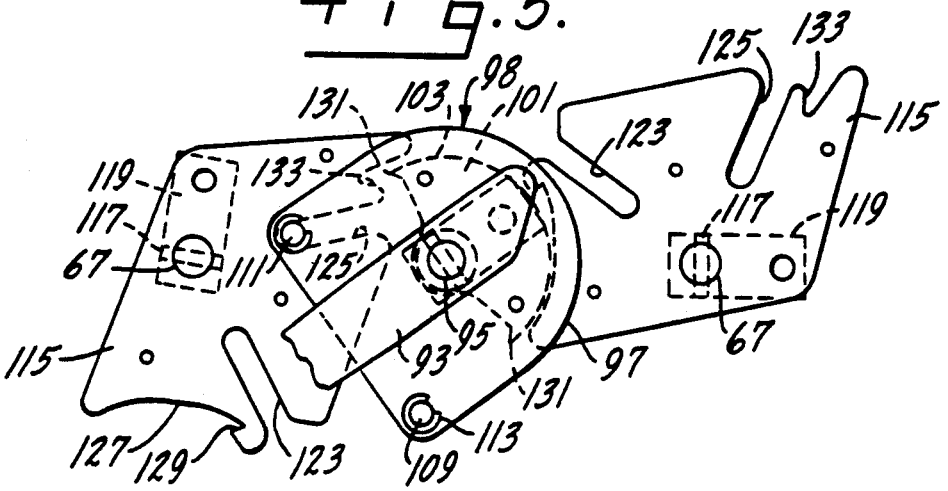
Fig. 6.
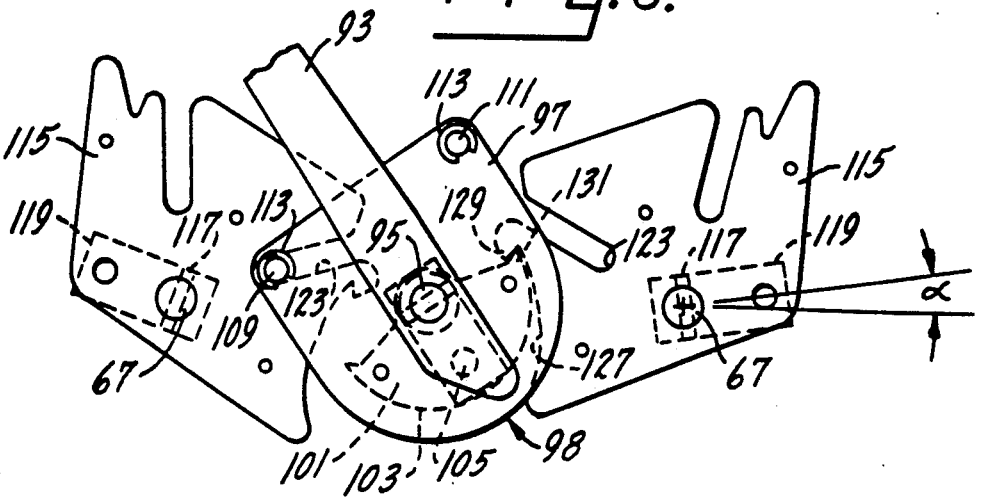

DUAL SWITCH ACTUATOR MECHANISM WITH GENEVA DRIVE PLATE AND FOLLOWER PLATES DETENT ASSEMBLY

BACKGROUND OF THE INVENTION

This invention relates to a dual switch actuator mechanism for coordinated actuation of two high-current switches, each of which switch includes a switch operator mechanism for opening and closing the switch in response to operation of a switch operator shaft. Such mechanisms are shown in Erickson, et al. U.S. Pat. No. 4,103,133, and these mechanisms may be used on pairs of switches where it is desirable to close one switch while maintaining the other switch in its open position, called a "break-before-make" arrangement or to open one switch while maintaining the other switch closed, called a "make-before-break" arrangement.

In installations of dual load-break bolted pressure contact switches carrying loads of currents of the order of 400 to 6,000 amperes controlled by a dual switch operating mechanism which switches are operated in a "break-before-make" arrangement, a potentially hazardous situation may occur when the contacts of a switch weld in a partially closed position. Such a weldment is usually caused by the failure of the switch contacts to rapidly disengage when the switch is moved from a closed to an open condition. In such a situation, the Geneva follower plate of the switch that becomes welded may not rotate to its fully open position but may hang up in a position near but not completely at its fully open position. Even though this operator plate is not in its fully open position, the operator handle and its shaft may return to the neutral position leading an operator to erroneously believe that both switches are fully open. The operator handle may then be rotated from its neutral position to rotate its Geneva drive plate into engagement with the other Geneva follower plate to close the switch associated with this plate while at the same time the first switch is not completely open and is at least partially closed.

SUMMARY OF THE INVENTION

Thus, an object of this invention is to provide a new and improved mechanism for coordinated actuation of two high-current switches operated in a "break-before-make" arrangement which mechanism will prevent the closing of one switch when the contacts of the other switch are welded or hung up in a partially closed condition.

Another object of this invention is to provide a new and improved mechanism for coordinated actuation of two high-current switches operated in a "break-before-make" arrangement which mechanism will prevent the closing of one switch when the contacts of the other switch are welded in a partially closed condition and which may also be used with "make-before-break" arrangements of operating switches.

Another object of this invention is to provide a new and improved mechanism for coordinated actuation of two high-current switches operated in a "break-before-make" arrangement which will prevent the closing of one switch when the contacts of the other switch are welded in a partially closed condition but will permit rotation of the operating lever and its Geneva drive plate to break loose the welds holding the switch contacts in their partially closed condition.

Accordingly, the invention relates to a dual switch actuator mechanism for coordinated actuation of two high-current switches of the type having a switch operator mechanism for opening and closing the switch in response to rotation of a switch operator shaft in opposite directions. The switches are mounted adjacent each other with the switch operator shafts arranged in aligned paraxial spaced relation to each other. The dual switch actuator mechanism includes a rotatable main shaft which is positioned between and in aligned paraxial relation to the two switch operator shafts. A Geneva drive plate is affixed to the main shaft for rotation therewith and it has an arcuate bearing surface. A pair of drive pins are mounted in spaced relation to each other on the Geneva drive plate. Modified Geneva follower plates are each affixed to the switch operator shaft of a respective switch mechanism. Each follower shaft has a drive slot for receiving one of the drive pins. Each follower plate further has an arcuate bearing surface which is complementary to the drive plate bearing surface. The follower plates are aligned relative to the main shaft and the drive plate so that for a given neutral position of the main shaft, each drive pin is positioned in the entrance of a follower plate drive slot and the bearing surfaces of both follower plates engage the drive plate follower surface, Rotation of the main shaft through a predetermined arc in either direction from a neutral position causes one guide pin to move inwardly of the drive slot of one follower plate to thereby rotate that follower plate and its associated switch operator shaft. This moves one of the switches between open and closed positions without actuation of the other switch. A detent mechanism is provided to prevent rotation of the main shaft in either direction from the neutral position to engage one of the follower plates and rotate it and its associated switch operator shaft to actuate its switch when the other of the follower plates is in a position of rotation slightly short of its fully open position. Such a situation can occur if the switch contacts associated with the switch of the other follower plate are welded in a partially closed position.

BRIEF DESCRIPTION OF THE DRAWINGS

FIG. 4 is a partial front view of the dual switch actuator mechanism of this invention with the detent means shown in dashed lines;

FIG. 5 shows the mechanism of FIG. 4 with the actuator mechanism in one actuating position; and FIG. 6 shows the mechanism of FIG. 4 with the actuator mechanism blocked from being moved to one actuating position by the detent mechanism of this invention.

DESCRIPTION OF THE PREFERRED EMBODIMENT

Figure 1:
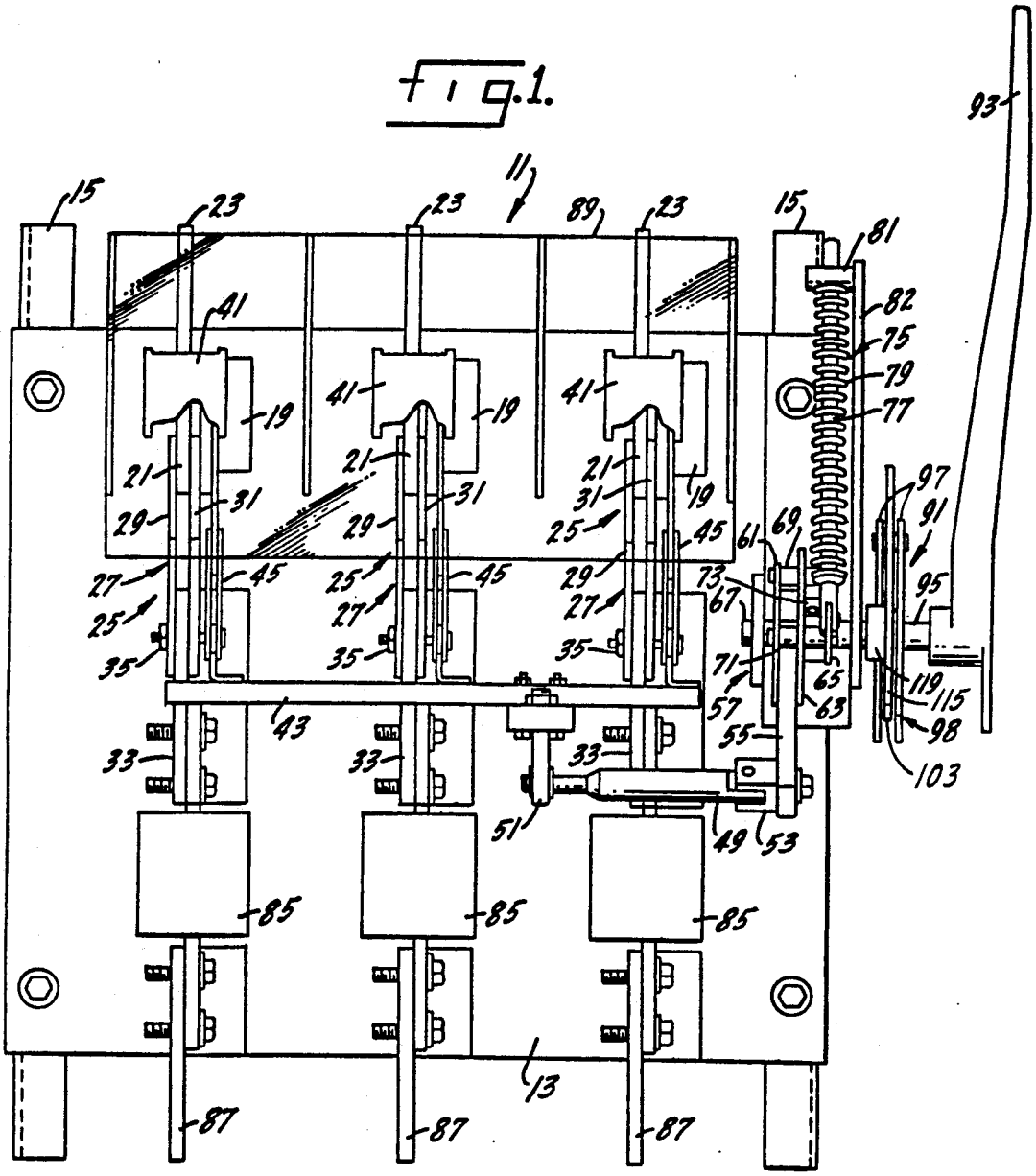
FIG. 1 is a front elevational view of a pair of load-break bolted pressure contact switches positioned back to back and operatively connected by a dual switch actuator mechanism in accordance with the teachings of this invention.
Figure 2:
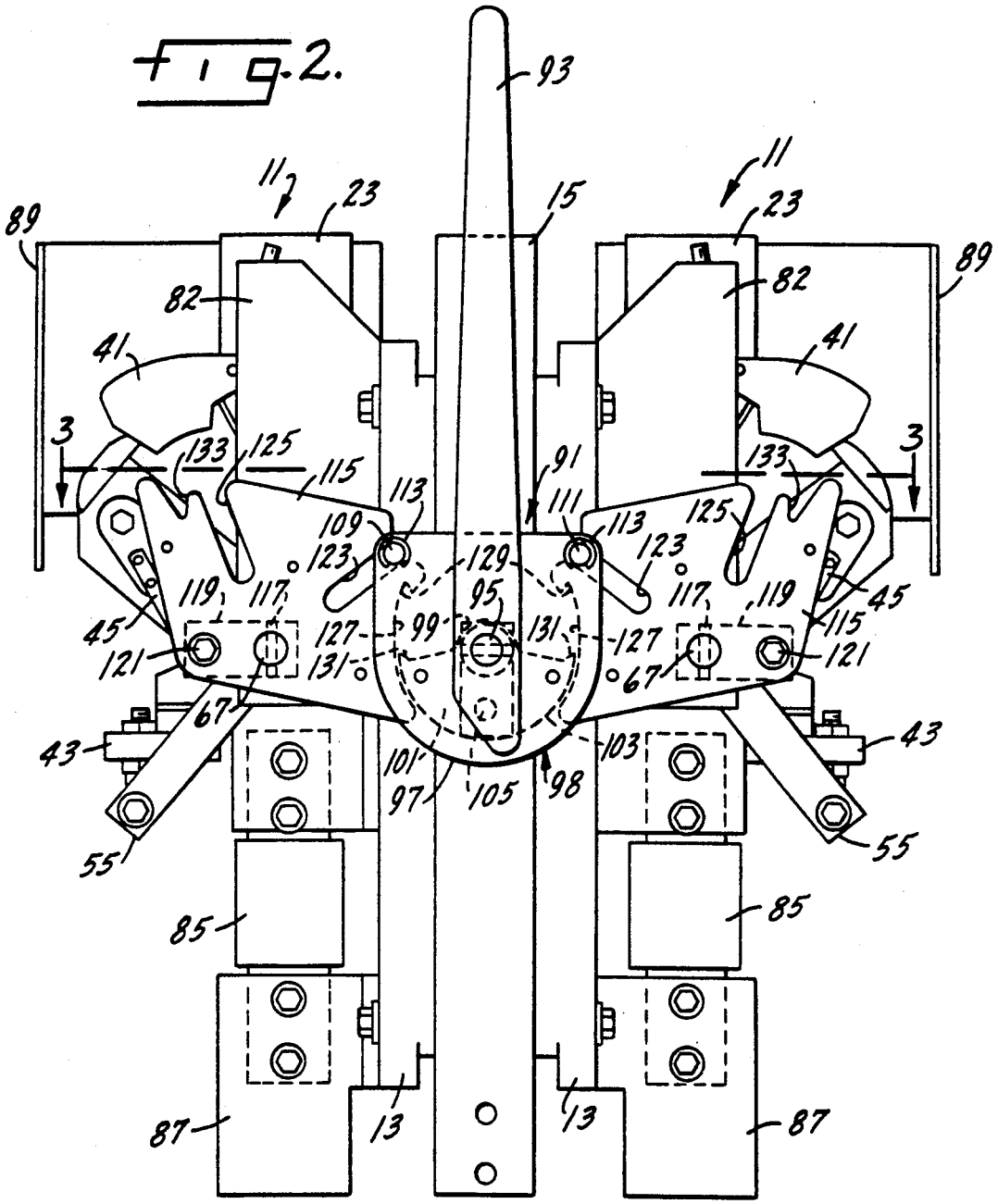
FIG. 2 is an end elevational view of the switches of FIG. 1.
Figure 3:
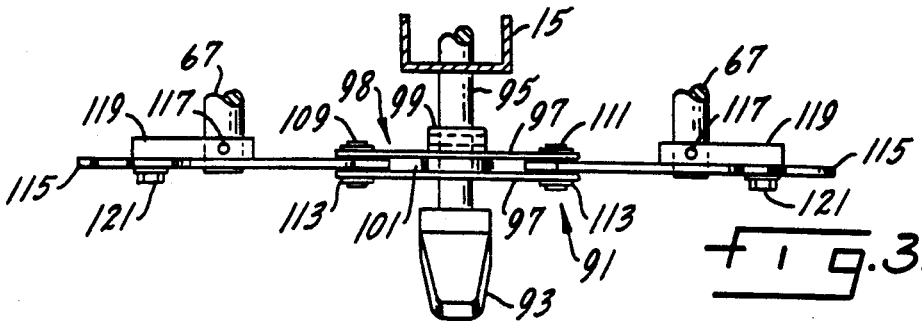
FIG. 3 is a partial view taken along line 3—3 of FIG. 2.

FIGS. 1 and 2 of the drawings illustrate a pair of load-break bolted pressure contact switches 11, of known construction, positioned back to back and connected for coordinated operation in accordance with the teachings of this invention. Switches of this type are illustrative of high-current switches to which this invention is directed. Each switch 11 includes a base member 13 fabricated from a suitable insulating material. The base members 13 of the back to back switches are bolted to vertical metal channels 15 positioned between the base members adjacent opposite ends thereof.

At the top of each base member 13, there are mounted three spaced fixed contact members 19. Each of the fixed contact members 19 is provided with an outwardly projecting contact blade 21 and a terminal lug 23. Each of the fixed contact members 19 is one element of a pole 25 of a switch 11. Each fixed contact 19 is engageable by a movable contact 27. Each of the movable contacts 27 of a pole comprises a pair of contact blades 29 and 31. Each of contact blades 29 and 31 is pivotally mounted on a terminal lug 33 by means of a suitable pivot member 35 including a bolt and nut.

An arc chute 41 is mounted on each fixed contact member. A suitable arc chute is shown in U.S. Pat. No. 3,441,699 but the invention should not be limited to the use of the particular arc chute shown in that patent since that arc chute is merely illustrative of a number of different arc chutes which may be used.

Each switch 11 further includes an actuating bar 43 that extends transversely of the switch and is connected to each of the movable contacts 27 by means of a connecting linkage 45 so that arcuate movement of the actuating bar with respect to the pivotal connection of the movable contact 27 drives the movable contact of the switch pivotally into and out of engagement with the fixed contacts 19.

Switches 11, as thus far described, correspond generally to the construction of the load-break bolted pressure contact switch described and claimed in U.S. Pat. No. 3,213,247. The present invention is not directed to the switch structure per se, and should not be construed as limited to use with the particular load-break switch structure of U.S. Pat. No. 3,213,247 or with the switch structure shown herein, both of which are merely illustrative of several of a number of different forms of switches in which the invention may be incorporated.

The actuating bar 43 of each switch 11 is connected to an operating rod 49 by means of a socket type universal connection 51. A connector of this type is marketed under the designation "ALINABAL". The opposite end of each operating rod 49 is pivotally connected to a clevis 53 mounted on one side of an operating lever 55 at the free end thereof. The operating lever 55 may be formed of a suitable insulating material and its rotation is controlled by a lost motion switch operator mechanism 57. The lost motion switch operator mechanism 57 may take many forms, one of which is shown in U.S. Pat. No. 4,137,433, issued Jan. 30, 1979, which is assigned to the same assignee as this application. However, the present invention is not directed to the lost motion switch operator mechanism per se and should not be construed as limited to use with the particular lost motion switch operator mechanism shown in said patent which is merely illustrious of one of several of a number of different forms of switch operator mechanisms in which the invention of this application may be incorporated.

The lost motion switch operator mechanism 57 includes spaced plates 61, 63 and 65 which are rotatably mounted on a switch operator shaft 67. The plates are connected by three pins, two of which, pins 69 and 71, are shown in the drawings herein. A crank arm 73 is rigidly fixed to shaft 67 and rotates therewith to engage the pins extending between and connecting the plates. After a suitable amount of rotation of the mechanism, the pins will engage the operating lever 55 and cause it to rotate.

An overcenter spring mechanism 75 is pivotally connected to the follower plate 65 of the lost motion switch operator mechanism. The overcenter spring mechanism is of the toggle type and includes a drive rod 77 extending through a coil spring 79. The upper end of the drive rod is slidably and pivotally mounted in an opening (not shown) formed in the apex of the inverted V-shaped support 81 which is fastened to the upper end of a bracket 82 which is attached to the base member 13. The coil spring 79 is captured between the V-shaped support 81 and a stop pin and washer (not shown) positioned near the lower end of the drive rod. The lower end of the drive rod is pivotally connected to the follower plate 65 of the lost motion connection by means of a pivot pin (not shown) which rides in an elongated slot (not shown) in the follower plate 65.

The switch operator shaft 67 is journalled in the support bracket 82 and extends outwardly beyond the support bracket where it is attached to the dual switch actuator mechanism of this invention. As is most clearly shown in FIGS. 2 through 6 of the drawings, a switch operator shaft 67 is provided for each switch 11.

Appropriate overload fuses 85 are installed between lugs 33 and terminal lugs 87. A transparent protective shield 89 of the type described and claimed in U.S. Pat. No. 4,110,584, issued Aug. 29, 1978, is shown positioned in front of the switch contacts of each switch 11.

The dual switch actuator mechanism 91 of this invention joins the shafts 67 of the lost motion switch operator mechanisms 57 of the switches 11 for coordinated actuation. This mechanism 91 includes an operating handle 93 affixed to a main shaft 95 which is journalled in one of the channels 15 and extends in paraxial spaced relation to the shafts 67. It should be understood that a drive motor, a hand wheel or other mechanism may be substituted for the operating handle 93. A drive plate assembly 98 comprising a pair of spaced drive plates 97 is affixed to the main shaft 95 by a drive block 99. The plates 97 are joined by an inner plate 101 which has an arcuate bearing surface 103. The assembly 98 comprising plates 97, block 99, and plate 101 is held together by a fastener 105. Drive pins 109 and 111 extend between the drive plates 97 at locations outwardly of the inner plate 101 with the drive pins being held in position by clips 113 (FIG. 2) which fit into slots (not shown) formed in the pins. As can be most clearly seen in FIG. 2 of the drawings, the drive pins 109 and 111 are located symmetrically with respect to the main shaft 95.

A modified Geneva follower plate 115 is rigidly connected to each switch operator shaft 67 by means of a pin 117 which fastens the shaft to a block 119 which in turn is connected by a fastener 121 to the modified Geneva follower plate. The geneva follower plate 115 is irregular in shape, with the shaft being connected to the plate near the center thereof. An outwardly opening radial slot 123 is formed in the plate and is aligned with the switch operator shaft 67. A second outwardly opening radial slot 125 is located at an angle of less than 90° relative to the slot 123 and is also aligned with the shaft 67. One side wall of the follower plate 115 forms an arcuate bearing surface 127 which is complementary to bearing surface 103 of the inner drive plate 101. Hook-like notches 129 are formed at the opposite ends of the arcuate bearing surface 127. These notches are shaped to receive teeth 131 formed on diametrically opposite sides of the inner drive plate 101. The notches 129 and teeth 131 form detent means to limit rotation of the drive plate 101. A stop notch 133 is formed on the Geneva follower plate 115 adjacent the radial slot 125.

In considering the operation of the dual switch actuator mechanism 91 of this invention, it may be assumed that both switches 11 are open, as shown in FIGS. 1 and 2 of the drawings. Under these circumstances, the operating handle 93 is in the vertical or neutral position shown in the drawings, with the drive pins 109 and 111 positioned near the entrances of the slots 123 of the Geneva follower plates 115. Assume the operating handle 93 is rotated in a counterclockwise direction, as viewed in FIGS. 2 and 4 of the drawings, through an arc of approximately 135° to the position shown in FIG. 5 of the drawings. During the counterclockwise rotation of the main shaft 95, which is attached to the handle 93, the drive pin 109 first moves radially inwardly of the slot 123 of the Geneva follower plate 115 on the left hand side of the mechanism, rotating that follower plate in a clockwise direction. As the shaft 95 continues to rotate in a counterclockwise direction, with the drive pin 109 moving inwardly along the slot 123 of the left hand Geneva follower plate, the other drive pin 111 moves out of the slot 123 of the Geneva follower plate on the right side of the main shaft 95. At the same time, the arcuate bearing surface 103 of the inner drive plate 101 moves out of contact with the arcuate bearing surface 127 of the Geneva follower plate 115 on the left hand side of the handle. However, bearing surface 103 remains in contact with the arcuate bearing surface 127 of the Geneva follower plate on the right hand side of the main shaft 95.

Continued counterclockwise movement of the main shaft 95 subsequently moves the drive pin 109 out of the slot 123 of the Geneva follower plate being rotated and brings the other drive pin 111 into the slot 125 of the same Geneva follower plate. Counterclockwise rotation of the main shaft 95 is stopped when the tooth 131 of the inner drive plate 101 engages the stop notch 133 on the Geneva follower plate 115 which is being rotated. The final position of the main shaft 95 is shown in FIG. 5.

During the entire period of rotation of the Geneva plate 115 on the left hand side of the main shaft 95 as viewed in FIGS. 2 and 4, the opposite Geneva follower plate will be held against rotation by engagement of the arcuate surface 103 of the inner drive plate 101 of the main shaft 95 with the complementary bearing surface 127 formed on the Geneva follower plate.

Rotation of the Geneva follower plate 115 on the left hand side of main shaft 95 in a clockwise direction rotates the shaft 67 of the switch operator mechanism 57 in a clockwise direction. Rotation of the shaft 67 will actuate the overcenter toggle mechanism 75 to move the operating lever 55 from its lowered position, as shown in FIGS. 1 and 2, to its upper position closing the switch 11 located on the left hand side of the main shaft 95.

The preceding description of the rotation of the operating handle 93 in a counterclockwise direction to rotate the Geneva follower plate 115 on the left hand side of the main shaft 95, as shown in FIGS. 4 and 5 of the drawings, was based on the assumption that the Geneva follower plate 115 on the right hand side of the shaft 95 was in its maximum position of clockwise rotation which occurs when its switch contacts 21 and 27 are in their fully disengaged or fully open condition of the switch.

FIG. 6 of the drawings shows a situation where the switch contacts associated with the switch operator shaft 67 of the Geneva follower plate 115 on the right hand side of the main shaft 95 is a few degrees away from or short of its position of complete clockwise rotation, a position that the plate 115 could be in if its switch contacts 21 and 37 were welded or fused in a partially closed position. When this occurs, the right hand Geneva follower plate 115 is located in an orientation which is a few degrees (shown by the angle $\alpha$) in a counterclockwise direction short of its fully open condition such that the socket 129 at the end of the arcuate bearing surface 127 is moved into the path of rotation of the tooth 131 of the inner drive plate 101 of the drive plate assembly 98. When counterclockwise rotation of the operating handle 93 is attempted for the purpose of rotating the left hand Geneva follower plate 115 in a clockwise direction so as to close its switch contact blades 21 and 27, the tooth 131 is received in the notch 129 of the right hand Geneva follower plate 115 and further counterclockwise rotation of the handle 93 is prevented. When the operator realizes that the operating handle cannot be rotated through its full 135° arc in a counterclockwise direction, it will be apparent that the switch contacts of the right hand switch are not fully open. The operating handle can then be rotated in a clockwise direction so that the drive pin 111 will move radially in the slot 123 of the right hand Geneva follower plate 115 to force the switch operator shaft 67 and the contact blades 21 and 27 of this switch to their fully open position to thereby break the welds and restore proper operation of the dual switch operator mechanism.

What is claimed is:

1. A dual switch actuator mechanism for coordinated actuation of two high-current operating switches, each switch including a switch operator mechanism for opening and closing the switch in response to rotation of a switch operator shaft in opposed directions, the switches being mounted adjacent each other with the switch operator shafts in aligned paraxial spaced relation to each other, the dual switch actuator mechanism comprising:

a rotatable main shaft positioned between and in aligned paraxial relation to the two switch operator shafts, a Geneva drive plate affixed to the main shaft for rotation therewith and having an arcuate bearing surface, a pair of drive pins mounted in spaced relation to each other on the Geneva drive plate, two modified Geneva follower plates, each affixed to the operator mechanism, each Geneva follower plate having a drive slot for receiving one of the drive pins and each Geneva follower plate further having an arcuate bearing surface complementary to the Geneva drive plate bearing surface, the Geneva follower plates being aligned, relative to the main shaft and Geneva drive plate, so that for a given neutral position of the main shaft, each drive pin is positioned in the entrance of a Geneva follower plate drive slot and the bearing surfaces of both Geneva follower plates engage the Geneva drive plate bearing surface, rotation of the main shaft through a predetermined arc in either direction from a neutral position causing one guide pin to move inwardly of the drive slot of one Geneva follower plate to rotate that Geneva follower plate and its associated switch operator shaft and thereby actuate one of the switches between open and closed conditions without actuation of the other switch, the improvement comprising:

detent means formed on said Geneva drive plate and said modified Geneva follower plates, said detent means being positioned to be operative to stop rotation of said Geneva drive plate when the Geneva drive plate is rotated from its neutral position to engage one of said Geneva follower plates in a closing sequence of its switch and the other Geneva drive plate is in a position of rotation slightly short of its fully open position.

2. The dual switch actuator mechanism of claim 1 in which said detent means include teeth and teeth-receiving sockets, said teeth being located on one of and said teeth-receiving sockets being located on the other of said Geneva drive plate and said Geneva follower plates.

3. The dual switch actuator mechanism of claim 1 in which said teeth are formed on diametrically-opposed sides of said Geneva drive plate and said teeth-receiving sockets are formed on said Geneva follower plates.

4. The dual switch actuator mechanism of claim 3 in which said teeth and teeth-receiving sockets rotate in arcs which do not intersect when said Geneva drive plate is rotated from its neutral position into engagement with one of said Geneva follower plates to close the switch associated with said Geneva follower plates and the other of said Geneva follower plates is in its fully open position of rotation.

* * * * *